US007281824B2

(12) United States Patent
Wijbenga et al.

(10) Patent No.: US 7,281,824 B2
(45) Date of Patent: Oct. 16, 2007

(54) LUMINAIRE WITH REFLECTOR HAVING TWO PORTIONS WITH DIFFERENT OPTICAL AXES

(75) Inventors: Hendrik Wijbenga, Eindhoven (NL); Jean Paul Entrop, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 148 days.

(21) Appl. No.: 10/513,283

(22) PCT Filed: Apr. 11, 2003

(86) PCT No.: PCT/IB03/01535

§ 371 (c)(1),
(2), (4) Date: Nov. 2, 2004

(87) PCT Pub. No.: WO03/093723

PCT Pub. Date: Nov. 13, 2003

(65) Prior Publication Data

US 2006/0044805 A1 Mar. 2, 2006

(30) Foreign Application Priority Data

May 6, 2002 (EP) ..... 02076786

(51) Int. Cl.
*F21V 7/00* (2006.01)

(52) U.S. Cl. ..... 362/297; 362/296; 362/341; 362/347; 362/348; 362/516; 362/517; 362/518

(58) Field of Classification Search ..... 362/516–518, 362/296, 297, 341, 347, 348
See application file for complete search history.

(56) References Cited

U.S. PATENT DOCUMENTS

| | | | | |
|---|---|---|---|---|
| 6,227,684 | B1 * | 5/2001 | Wijbenga et al. | 362/310 |
| 6,568,835 | B2 * | 5/2003 | Wijbenga et al. | 362/349 |
| 2002/0154506 | A1 * | 10/2002 | Wijbenga et al. | 362/348 |

FOREIGN PATENT DOCUMENTS

| | | | |
|---|---|---|---|
| EP | 1204011 | A2 | 5/2002 |
| EP | 1204011 | A3 | 5/2002 |
| WO | WO1275358 | A1 | 10/2001 |

* cited by examiner

*Primary Examiner*—Stephen F. Husar
*Assistant Examiner*—Meghan K. Dunwiddie

(57) ABSTRACT

A luminaire has a concave reflector with an optical center on an optical main axis in an optical main plane. A screen extends along the optical main axis to a light emission window. The reflector has a first faceted reflector portion at a first side of the optical main plane, the optical center being its focus and the optical main axis being its axis. A second faceted reflector portion is present at a second side of the optical main plane, having a secondary axis passing through and a focus lying in the optical center. The secondary axis is tilted with respect to the main axis through acute angles in the main plane as well as out of the plane. The luminaire produces a screened-off light beam which is horizontally and vertically asymmetrical, which makes the luminaire suitable for an illumination of highways in a counter-traffic direction.

21 Claims, 3 Drawing Sheets

LUMINAIRE WITH REFLECTOR HAVING TWO PORTIONS WITH DIFFERENT OPTICAL AXES

Figure 1:
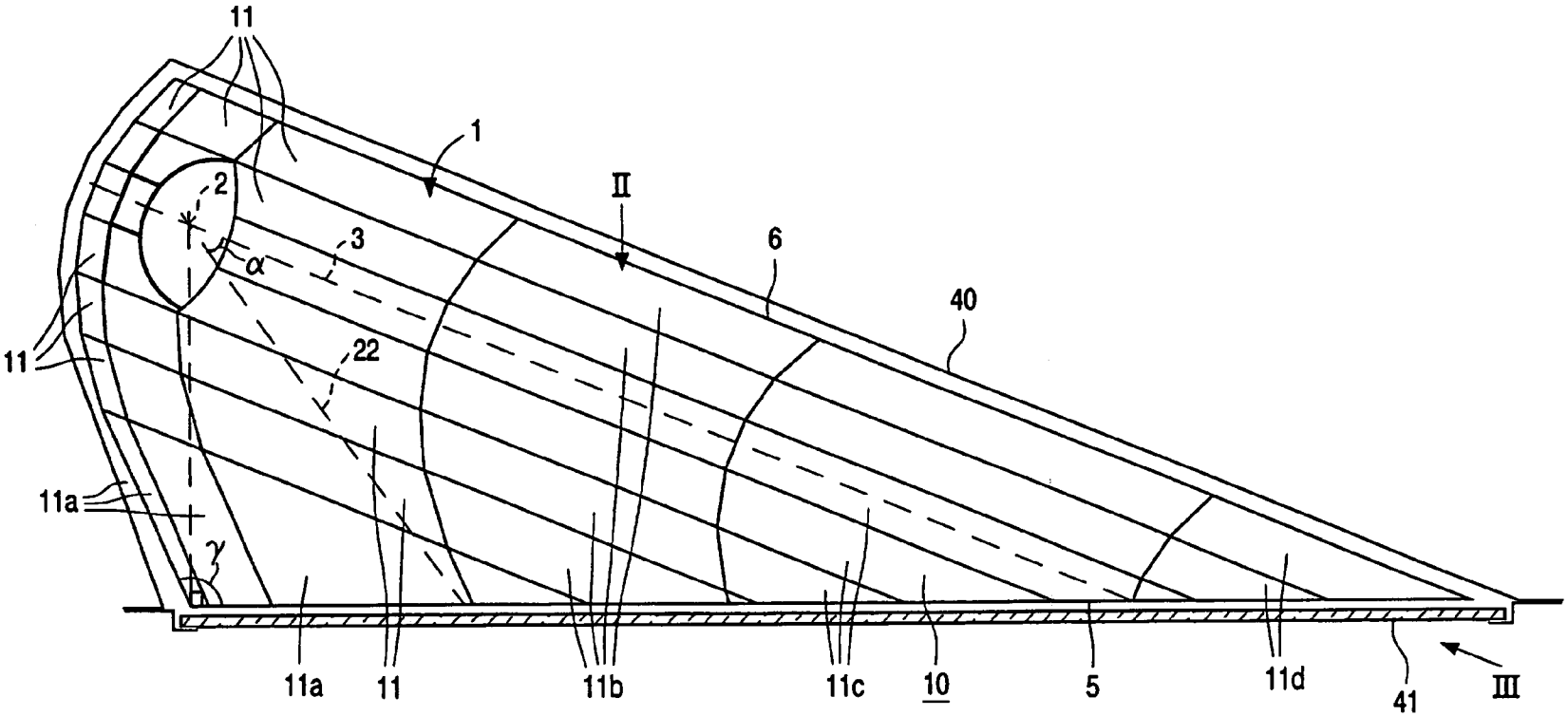

The invention relates to a luminaire provided with:

a concave reflector with an optical center on an optical main axis which is located in an optical main plane;

a light emission window which encloses an acute angle with the optical main axis and which is transverse to the optical main plane;

a reflecting screen having a length along the optical main axis, which screen extends along the optical main axis, transversely to the optical main plane, from the reflector to the light emission window;

means for accommodating an electric lamp with a light source, such that the light source is present around the optical center, which reflector is provided with:

a first concave facetted reflector portion which extends along a first side of the main plane to beyond the main plane at a second side of the main plane and which defines the main axis and the optical center; and a second facetted reflector portion which extends at a second side of the main plane and which has a secondary axis which passes substantially through the optical center and is tilted with respect to the main axis substantially in the optical center, i.e. tilted towards the light emission window so as to enclose an acute angle $\alpha$ with the main axis in projection on the main plane, and tilted from the main plane so as to enclose an acute angle $\beta$ with the main plane, while the facets of the first reflector portion extend along the screen.

An embodiment of such a luminaire is described in the patterned application EP 01204011.9 not previously published.

The luminaire described therein is asymmetrical and, also as a result of this, is suitable for illuminating highways against the direction of the traffic.

Because of the asymmetry of the luminaire described, a given luminaire will be suitable for illuminating a road half for left-hand traffic from a mast in the central reservation of a road, and accordingly also for illuminating a road half for right-hand traffic when the mast is placed at the side of the road, but in that case a mirrored embodiment of said luminaire is necessary for illuminating a road half for right-hand traffic from the central reservation of the road, or for illuminating a road half for left-hand traffic from the side of the road.

It is very effective to illuminate a road surface with a light beam which radiates against the traffic. Light reflected by the road surface then radiates mainly upwards towards the road user, so that the latter sees the road surface. Luminaires used in conventional road lighting radiate from a mast in downward direction on either side of the mast, i.e. one half at the side of the mast facing away from the road user. This light is partly diffusely scattered by the road surface, but partly also directionally reflected away from the road user and is accordingly partly not observed by the road user. If the road surface is mirroring, for example in the case of a smooth asphalt surface, but especially if the road surface is wet, the mirroring reflection by the road surface will be more important, and the diffuse scattering less so. The road surface is very dark then. The light carried by the road user himself is also specularly reflected away from him. With the opposed lighting direction, by contrast, much light is reflected to the road user by the road surface if the latter is mirroring, for example wet, so that the road surface and the nature of the road surface are well visible.

In the luminaire described, a panel is present at the first side of the main plane, which panel extends from the screen into the light emission window, and which panel bounds the reflector. The second reflector portion is also concave and has curvatures which are different from those of the first reflector portion. A third reflector portion with rows of triangular facets connects the first reflector portion to the second. The luminaire is suitable for accommodating a compact light source, such as a high-pressure metal halide discharge lamp with a ceramic lamp vessel. Such a lamp may have a discharge arc of, for example, 12 mm in a discharge vessel of, for example, 12 mm diameter, so that the light source is square in lateral elevation.

It is an advantage of the described luminaire that it need not be mounted centrally above the road lane for one driving direction when used for road lighting against the driving direction, so that gantries across the road are avoided and the use of the luminaire is comparatively inexpensive.

It is a disadvantage of the described luminaire, however, that screening means are necessary if it is to be prevented that the luminaire also radiates light directly and against the main direction of the beam of reflected light, i.e. in the driving direction of the traffic onto the road portion illuminated by the luminaire. Such directly radiated light reduces the contrast of obstacles present on the road and moreover does not contribute to the luminous intensity of the light beam formed by the reflector. Without such light, in addition, a luminance of an illuminated road surface of 0.5 to 1 $cd/m^2$ can suffice, i.e. a comparatively low energy consumption, whereas double that value is to be aimed at with such light.

It is an object of the invention to provide a luminaire of the kind described in the opening paragraph which is suitable for placement laterally of a road while illuminating a road half against the driving direction of the traffic on said road half in a homogeneous manner, while the radiation of unreflected light against the direction of the light beam formed by the reflector is counteracted, but the use of screening means for this purpose is avoided.

According to the invention, this object is achieved in that the first reflector portion encloses an obtuse angle $\gamma$ with the light emission window in the optical main surface, while the first reflector portion merges into the second reflector portion.

Owing to the obtuse angle, the reflector extends comparatively far below the accommodated lamp after placement on a mast laterally of a road. In addition, the lamp is located in a comparatively high position inside the reflector as a result of this. The reflector itself accordingly screens off a road portion which lies beyond the mast away from the lamp, viewed in the driving direction of the traffic. It may be undesirable, however, if the luminaire provides no light at all on the road portion beyond the mast, because then there would be a discontinuity in the luminance of the road, in dependence on the spacing of consecutive luminaires.

It is accordingly favorable in general if the first reflector portion extends at least to adjacent a perpendicular projection of the optical center in a plane in which the light emission window is located.

The luminaire according to the invention provides a light beam during operation which is asymmetrical both in vertical and in horizontal planes. During operation, when mounted to a mast laterally of a road half for traffic in one direction, with the light emission window being at least substantially horizontal and facing downwards, and the screen directed towards oncoming traffic, said screen will provide a natural shield against radiation of light, both light radiated directly to the exterior by the lamp and light radiated after reflection, in horizontal directions and in downward directions enclosing a small angle, in general an angle up to 10°, with the horizontal. Dazzling is prevented thereby. The reflector itself also contributes to this screening at angles with the main plane greater than the downward angles in which the screen is operative. The screen in general encloses an angle with the light emission window which lies between approximately 20° and approximately 25°.

The first reflector portion forms a main light beam which hits the road half for the traffic in one direction in its full width at a comparatively great distance from the luminaire, and which becomes narrower towards the luminaire so as to illuminate preponderantly the portion of the road half lying at the side where the luminaire is located.

The second reflector portion provides a secondary beam which illuminates the road half in its full width adjacent the mast and, up to a greater distance away from the mast, the opposite side of the road half. Added to this is the light radiated directly by the accommodated lamp, without previous reflection, plus the light reflected by the screen.

It is an advantage of the luminaire according to the invention that it has a comparatively wide range, so that comparatively few luminaires, and accordingly few masts, are necessary for illuminating a length of road.

The known luminaire described in the opening paragraph is suitable for accommodating a compact lamp, but the luminaire according to the invention is capable of accommodating such a compact lamp or an elongate lamp, such as a high-pressure sodium discharge lamp. Such a lamp of 100 W has a light source of approximately 70 mm length and approximately 5 mm diameter, and a lamp of 150 W a length of approximately 73 mm and a diameter of approximately 6 mm. High-pressure sodium discharge lamps have the advantage of a comparatively long lamp life, approximately 20,000 hours, and a high luminous efficacy, approximately 120 lm/W. They provide a golden-yellow light with comparatively much red and comparatively little blue, so that they have a limited color rendering index. Compact high-pressure metal halide discharge lamps have a life of approximately 12,000 hours and a luminous efficacy of approximately 95 lm/W, but they have a comparatively high color rendering index at a color temperature of, for example, 3000 or 4000 K. The advantage of the long lamps is that they consume little power thanks to their luminous efficacy and are inexpensive to maintain thanks to their long service life. If the luminaire is used with a high-pressure sodium lamp, it is favorable to give the luminaire greater dimensions because of the comparatively low luminance of the lamp than in the case in which a compact metal halide lamp is used.

It is an advantage of the luminaire according to the invention that the reflector surrounds the lamp over a comparatively large spatial angle owing to its shape, so that a comparatively large portion of the generated light is radiated as a concentrated and directional beam. The luminaire is very effective as a result of this.

It is easy for obtaining a good light distribution if the facets of the first reflector portion have corner points at least adjacent the optical main plane, which corner points lie at least substantially on a paraboloid. The axis of this paraboloid then coincides with the main axis and its focus with the optical center.

It is advantageous if the first reflector portion extends along the entire length of the screen substantially at the first side of the main plane. The entire reflecting surface area available in the luminaire is then utilized for reflecting the generated light in a directional beam.

It is favorable for the ease of manufacturing of the luminaire if the facets of the second reflector portion each extend along the light emission window from the first reflector portion substantially up to the screen.

It is advantageous for obtaining a homogeneous illumination if the second reflector portion has bend points in a plane perpendicular to the light emission window and to the second reflector portion and passing through the optical center, and has a final point in the light emission window, which points lie at least substantially on a parabola with a focus which coincides at least substantially with the optical center.

The reflector may be made, for example, from high-polish metal or from semi-high-polish metal so as to provide a specular or substantially specular reflection.

In a favorable embodiment, the screen has a paint coating which contains a specularly reflecting reflection component. The pain coating also has a diffusely reflecting reflection component. A luminaire with a reflector having such a paint coating is described in WO 01/75358. The paint coating has a light-transmitting binder in which light-reflecting particles are enclosed, but which is substantially free from said particles at its exposed surface. The particles may be formed, for example, from halophosphate, calcium pyrophosphate, strontium phosphate, or titanium dioxide. They may be surrounded by a pigment skin, for example of aluminum oxide. The binder may be, for example, a silicon polymer, a fluoropolymer, or a polyacrylate. The particles account for at most 75% of the coating volume. An attractive aspect of the coating is its high reflection coefficient of 0.95 or more, and furthermore the combination of specular reflection and diffuse reflection, whereby formed images of the light source will gradually merge into one another.

The paint coating promotes the homogeneity of the illumination of a road portion situated close to the mast, which receives light reflected by the screen.

It is favorable if the reflector, when used for a high-pressure sodium discharge lamp, has a mirroring metal surface. If a compact high-pressure discharge lamp is used, it is favorable if not only the screen, but also the reflector has the paint coating comprising a specularly reflecting reflection component, because of the high luminance of the lamp. The reflector then provides both a considerable amount of specular reflection and a considerable amount of diffuse reflection, so that the reflector has a greater spreading power.

In a favorable modification of the above embodiment which is of importance for the use of a compact light source, facets of the first reflector portion located adjacent the main plane and adjacent the screen are made of mirroring metal. This modification has the advantage that a portion of the first reflector portion is strongly specularly reflecting so as to obtain a high illuminance at a comparatively great distance.

The manufacture of this embodiment of the luminaire is easy if the facets of mirroring metal are present on a separate metal body which is fastened to the reflector. The specularly reflecting metal portion need not be shielded then during the application of the coating to a mirroring reflector. This further embodiment also has the advantage that a comparatively inexpensive, optically low-grade material may be used for the reflector.

If the luminaire according to the invention is used on the shoulder of a road, there is the risk that as yet unreflected light directly radiated from the luminaire to the exterior by the lamp will hit the other road half, for example if the luminaire is placed in a comparatively high position, or if the road half for oncoming traffic is comparatively narrow. Said unreflected light will then radiate along with the traffic direction on the other road half, thus reducing the contrast of obstacles on that road half.

This risk is counteracted in a favorable embodiment. In this embodiment, screening means extend along the main plane, at the first side thereof, so as to counteract a lateral radiation of unreflected light. The luminaire then has a more universal application, not only in the central reservation, but also on the shoulder of the road on comparatively high masts, and even on the shoulder of the road in the case of comparatively narrow road halves. The radiation of unreflected light at comparatively wide angles to the main plane is then in fact counteracted. The screening means may comprise, for example, one or several lamellae which are present, for example, in the light emission window.

The reflector may be accommodated in a housing, and the light emission window may be closed off with a plate, for example a flat transparent plate. The shape of the reflector with its screen may find expression in the housing. The luminaire will then be slim and streamlined, so that it catches little wind and can be mounted to a comparatively lightweight mast.

The luminaire according to the invention has a high efficiency because double reflections in the luminaire are avoided to a high degree, and reflecting material surrounds the lamp over a wide spatial angle.

Figure 2:
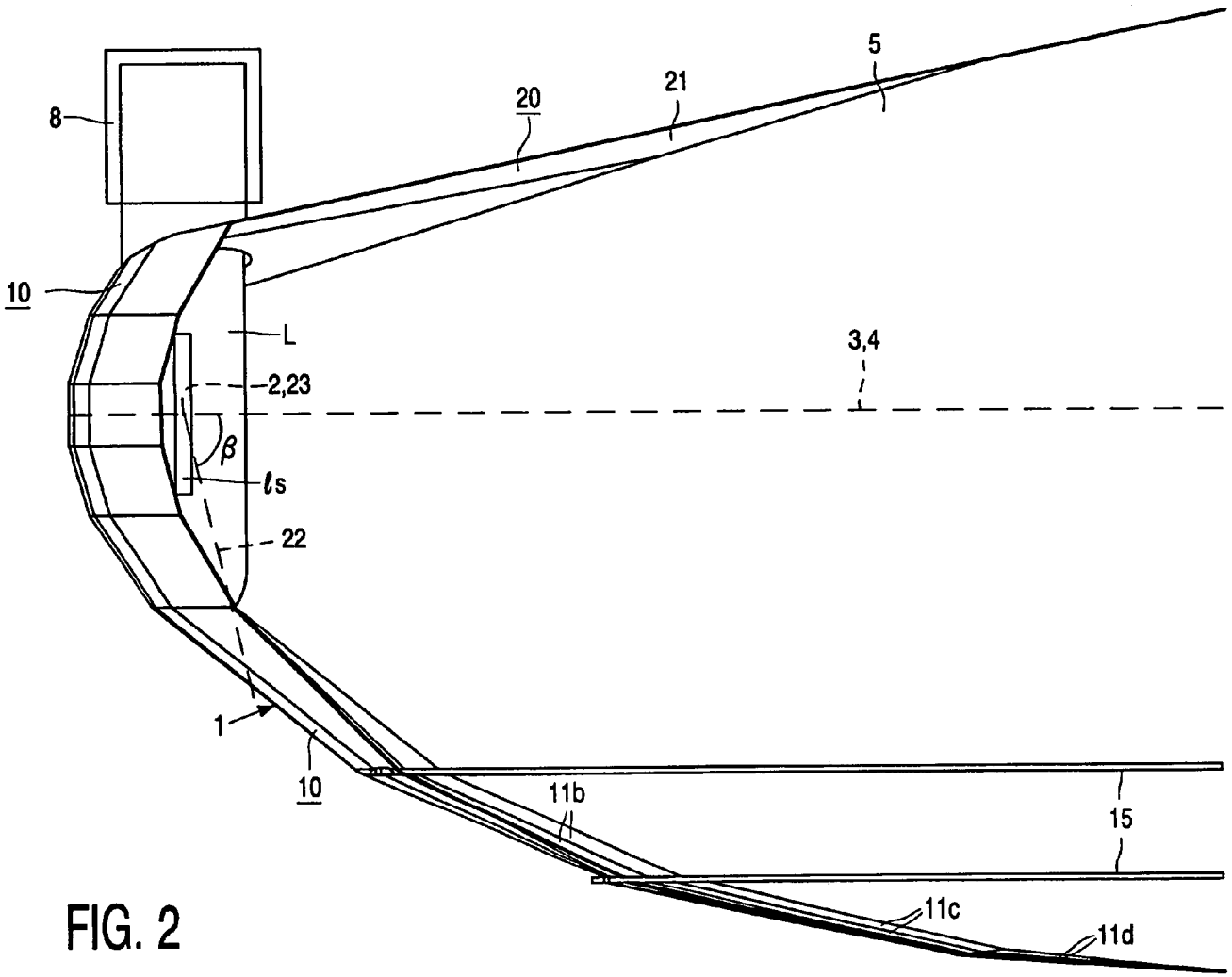
Figure 3:
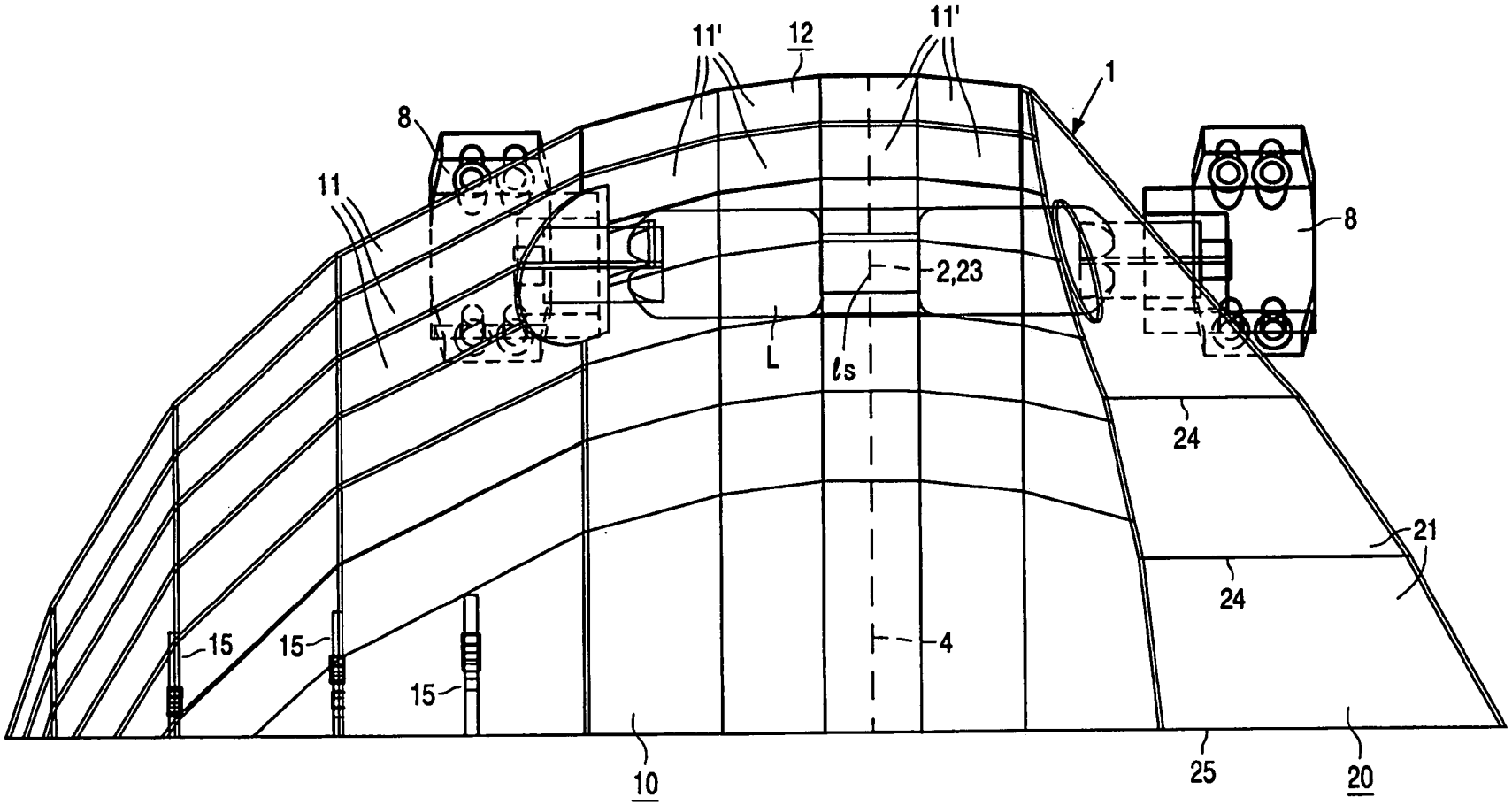

Embodiments of the luminaire according to the invention are shown in the drawing, in which FIG. 1 shows a first embodiment of the reflector in side elevation in a housing shown in cross-section;

FIG. 2 shows the reflector taken on the line II in FIG. 1 in the absence of the screen; and FIG. 3 shows the reflector of a modified version taken on the line III in FIG. 1.

In FIG. 1, the luminaire has a reflector 1 in a housing 40 which is closed off by a transparent plate 41. The luminaire shown may be positioned in the central reservation of a highway for left-hand traffic in the position shown, or on the shoulder of a road for right-hand traffic which approaches from the right in the Figure. The luminaire may be rotated through a small angle, for example of 13 to 25° towards the road, in this case.

In FIGS. 1 and 2, the concave reflector 1 has an optical center 2 on an optical main axis 3 which lies in an optical main plane 4. A light emission window 5 encloses an acute angle, an angle of 22° in the Figures, with the optical main axis 3 perpendicularly to the optical main plane 4. A reflecting screen 6 having a length along the main axis 3 extends along the optical main axis 3, perpendicularly to the optical main plane 4, from the reflector 1 into the light emission window 5. The luminaire has means 8 for accommodating an electric lamp L with a light source ls, said light source ls surrounding the optical center 2. FIG. 2 diagrammatically indicates a high-pressure sodium discharge lamp.

The reflector 1 has a first concave reflector portion 10 with facets 11, which portion extends along a first side of the main plane 4 to beyond the main plane 4 at a second side of the main plane 4, defining the main axis 3 and the optical center 2.

The reflector further comprises a second reflector portion 20 with facets 21, which second portion extends at a second side of the main plane 4 and has a secondary axis 22 which passes substantially through the optical center 2 and is tilted with respect to the main axis 3 substantially in the optical center 2. The secondary axis 22 is tilted both towards the light emission window 5, see FIG. 1, for enclosing an acute angle a with the main axis 3 in projection on the main plane 4, an angle of 33° in the Figure, as well as from the main plane 4, see FIG. 2, so as to enclose an acute angle β with the main plane 4, an angle of 77° in the Figure.

The facets 11 extend along the screen 6. When the luminaire is positioned with its light emission window 5 horizontal and facing downwards, the reflector 1 with the screen 6 prevents the lamp to be accommodated from being visible, and prevents light from being radiated at angles of 0 to approximately 15° to the horizontal during operation.

The first reflector portion 10 encloses an obtuse angle γ with the light emission window 5 in the optical main plane 4. The first reflector portion 10 merges into the second reflector portion 20.

The first reflector portion 10 extends at least up to adjacent a perpendicular projection of the optical center 2 in a plane in which the light emission window 5 is located.

The facets 11 of the first reflector portion have corner points at least adjacent the optical main plane 4, which corner points lie at least substantially on a paraboloid. The facets 11*a* in the embodiment shown have corner points in common with the facets 11 situated above them, which points lie on the paraboloid. If the facets 11*a* were to have the same width starting from said common corner points as the other facets 11, they would also lie on the paraboloid with their other corner points. The facets 11*a*, however, are prolonged in a direction towards the light emission window. The result of this is that light originating from the accommodated lamp and incident on the facets 11*a* adjacent the light emission window 5 is reflected in a more downward direction so as to illuminate the road surface adjacent the luminaire.

In the embodiment shown, the facets 11*b* have corner points which lie on the paraboloid, i.e. those corner points they share with the adjoining facets 11. The paraboloid in the embodiment shown has a focal distance of approximately 35 mm. The length of the facets is reduced for preventing that the reflector exceeds a chosen width, so that the corner points situated on the right in FIGS. 1 and 2 do not lie on the paraboloid. The direction of the facets 11*b*, however, is not changed. The facets 11*c* as a result have no corner points on the paraboloid in question, but on a different paraboloid having a longer focal distance, i.e. approximately 54 mm. The facets 11*d* complete the first reflector portion 10.

The first reflector portion 10 extends substantially at the first side of the main plane 4 along the entire length of the screen 6.

FIGS. 2 and 3 show that the facets 21 of the second reflector portion 20 each extend from the first reflector portion 10 along the light emission window 5 substantially up to the screen 6. In an alternative embodiment, however, these facets 21 are divided in their longitudinal direction so as to form a number of rows of facets, for example three rows, each row being tilted through a small angle, for example of one to a few degrees, with respect to the adjoining row. Such a subdivision of the facets 21, however, has little influence on the light beam.

It is favorable for the light distribution if the second reflector portion 20 has bend points 24 in a plane perpendicular to the light emission window 5 and to the second reflector portion 20 and passing through the optical center 2 as well as a final point 25 in the light emission window 5, which points lie at least substantially on a parabola with a focus 23 which coincides at least substantially with the optical center 2.

The screen 6 has a paint coating which comprises a specularly reflecting reflection component. In the embodiment shown, the reflector 1 has a specularly reflecting metal surface of semi-bright aluminum.

In FIG. 3, components corresponding to components of FIGS. 1 and 2 have been given the same reference numerals. The reflector 1 of FIG. 3 has the same shape as the reflector 1 of FIGS. 1 and 2.

In this embodiment, it is not only the screen 6, but also the first 10 and the second reflector portion 20 that have a paint coating comprising a specularly reflecting reflection component. The coating comprises 75% by volume of a light-transmitting silicone binder and 25% by volume of light-reflecting particles of titanium dioxide with an aluminum oxide skin. The exposed surface of the coating is substantially free from particles. Titanium dioxide and aluminum oxide have different refractive indices, i.e. approximately 2.32 and 1.63, whereby the specular reflection of the paint is further enhanced.

Facets 11' of the first reflector portion 10 located adjacent the main plane 4 and the screen 6 are made of mirroring metal, for example of aluminum, for example anodized aluminum, for example high-brightness aluminum, but in FIG. 3 of semi-bright aluminum.

The facets 11' of mirroring metal are present on a separate metal body 12 which is fastened to the reflector 1, in FIG. 3 by means of tongues at said body 12 which are passed through openings in the reflector 1 and are subsequently bent or twisted.

The facets 11 adjoining the light emission window 5 have the paint coating as their reflecting surface.

Screening means 15 extend along the main plane 4 at the first side thereof so as to counteract a lateral radiation of unreflected light. The mains 8 for accommodating the lamp L are of a dual construction, such that a double-ended lamp L is accommodated, having a compact light source ls.

The luminaire according to the invention may have combinations of described features other than those which are apparent from the claims.

The invention claimed is:

1. A luminaire comprising:

a concave reflector with an optical center on an optical main axis which is located in an optical main plane;

a light emission window which is transverse to the optical main plane;

a reflecting screen extending along the optical main axis, from the concave reflector to the light emission window; and means for accommodating a light source around the optical center, wherein the concave reflector includes:

a first reflector portion which extends along a first side of the optical main plane to a second side of the optical main plane; and a second reflector portion which extends along the second side of the optical main plane and which has a secondary axis which passes substantially through the optical center and is tilted with respect to the main axis; the first reflector portion forming an obtuse angle $\gamma$ with the light emission window.

2. The luminaire as claimed in claim 1, wherein the first reflector portion extends at least to a perpendicular projection of the optical center in a plane including the light emission window.

3. The luminaire as claimed in claim 1, wherein facets of the first reflector portion have corner points at least adjacent the optical main plane, wherein the corner points lie at least substantially on a paraboloid.

4. The luminaire as claimed in claim 3, wherein the first reflector portion extends along an entire length of the reflecting screen substantially at the first side of the optical main plane.

5. The luminaire as claimed in claim 1, wherein facets of the second reflector portion extend along the light emission window from the first reflector portion substantially up to the reflecting screen.

6. The luminaire as claimed in claim 5, wherein the second reflector portion has bend points in a plane perpendicular to the light emission window, and wherein the bend points lie at least substantially on a parabola having a focus which coincides at least substantially with the optical center.

7. The luminaire as claimed in claim 1, wherein the reflecting screen has a paint coating which contains a specularly reflecting reflection component.

8. The luminaire as claimed in claim 1, wherein the reflector has a paint coating which contains a specularly reflecting reflection component.

9. The luminaire as claimed in claim 1, wherein facets of the first reflector portion located adjacent the optical main plane and adjacent the reflecting screen are made of mirroring metal.

10. The luminaire as claimed in claim 9, wherein the facets of mirroring metal are present on a separate metal body which is fastened to the concave reflector.

11. The luminaire as claimed in claim 1, further comprising screening means that extend along the optical main plane to counteract a lateral radiation of unreflected light.

12. A luminaire comprising:

a reflector including a first part and a second part; and a light emission window positioned transverse to a main axis of the reflector;

wherein the first part and the light emission window form an obtuse angle, and wherein the reflector is configured to reflect out of the light emission window a light beam which is asymmetric in at least one of a vertical plane and a horizontal plane.

13. The luminaire of claim 12, wherein at least one of the first part and the second part include facets.

14. The luminaire of claim 12, wherein facets of the first part have corner points that lie at least substantially on a paraboloid.

15. The luminaire of claim 14, wherein a paraboloid axis of the paraboloid coincides with the main axis extending from an optical center of the reflector, and wherein a focus of the paraboloid coincides with the optical center.

16. A luminaire comprising:

a reflector including a first part and a second part;

a light emission window positioned transverse to a main axis of the reflector;

wherein the first part and the light emission window form an obtuse angle, wherein the second part has bend points in a plane perpendicular to the light emission window.

17. The luminaire of claim 16, wherein the bend points pass through an optical center of the reflector and a final point on the light emission window, and substantially lie on a parabola having a focus which substantially coincides with the optical center.

18. The luminaire of claim 16, further comprising a reflecting screen extending from the reflector to the light emission window.

19. The luminaire of claim 18, wherein the reflecting screen has a paint coating which contains a specularly reflecting component.

20. The luminaire of claim 1, wherein the optical center is along a perpendicular axis extending from an interface forming the obtuse angle $\gamma$ between the first reflector portion and the light emission window.

21. A luminaire comprising:

a reflector including a first part and a second part;

a light emission window positioned transverse to a main axis of the reflector;

wherein the first part and the light emission window form an obtuse angle, wherein an optical center of the reflector is along a perpendicular axis extending from an interface between the first part and the light emission window that forms the obtuse angle.

* * * * *